US008966723B2

(12) United States Patent
Lathrop et al.

(10) Patent No.: US 8,966,723 B2
(45) Date of Patent: Mar. 3, 2015

(54) ADJUSTMENT AND FIXATION SYSTEM OF PROTECTION VESTS

(75) Inventors: Jeremy Len Lathrop, Carregosa (PT); Sergio Bruno Oliveira Tavares, Carregosa (PT)

(73) Assignee: Polisport Plasticos, S.A., Carregosa (PT)

( * ) Notice: Subject to any disclaimer, the term of this patent is extended or adjusted under 35 U.S.C. 154(b) by 356 days.

(21) Appl. No.: 13/360,484

(22) Filed: Jan. 27, 2012

(65) Prior Publication Data

US 2012/0210500 A1 Aug. 23, 2012

(30) Foreign Application Priority Data

Feb. 17, 2011 (PT) ..... 105529

(51) Int. Cl.

| | |
|---|---|
| ***A41D 13/05*** | (2006.01) |
| ***A41F 19/00*** | (2006.01) |
| ***A44B 11/12*** | (2006.01) |
| ***A44B 11/00*** | (2006.01) |

(52) U.S. Cl.

CPC ..... *A41D 13/0556* (2013.01); *A44B 11/12* (2013.01); *A44B 11/005* (2013.01)

USPC ..... 24/593.11; 24/191; 2/338; 2/463

(58) Field of Classification Search

USPC ..... 24/68 A, 68 E, 68 SK, 191, 489, 593.11, 24/170; 2/338, 463

See application file for complete search history.

(56) References Cited

U.S. PATENT DOCUMENTS

| | | | | |
|---|---|---|---|---|
| 3,662,435 | A * | 5/1972 | Allsop | 24/70 SK |
| 4,607,398 | A | 8/1986 | Faulconer | |
| 5,758,895 | A | 6/1998 | Bumgarner | |
| 6,293,577 | B1 * | 9/2001 | Shields | 280/617 |
| 6,446,272 | B1 * | 9/2002 | Lee | 2/428 |
| 7,468,067 | B2 * | 12/2008 | Licata et al. | 606/203 |
| 7,665,190 | B2 * | 2/2010 | Weng | 24/170 |
| 7,866,008 | B2 * | 1/2011 | Laks | 24/68 SK |
| 8,108,973 | B2 * | 2/2012 | Chen | 24/170 |
| 8,117,680 | B1 * | 2/2012 | Chou | 2/450 |
| 2006/0107497 | A1 * | 5/2006 | Wung | 24/191 |
| 2007/0214610 | A1 * | 9/2007 | Fox | 24/3.1 |
| 2011/0000057 | A1 * | 1/2011 | Abdul | 24/68 SK |
| 2011/0041301 | A1 * | 2/2011 | Liang | 24/68 CD |
| 2012/0174280 | A1 * | 7/2012 | Strum et al. | 2/69 |

* cited by examiner

*Primary Examiner* — Robert J Sandy
*Assistant Examiner* — Louis Mercado
(74) *Attorney, Agent, or Firm* — John P. White; Cooper & Dunham LLP

(57) ABSTRACT

An adjustment and fixation system can be adopted, for example, for use with a protection vest for two-wheeled vehicle drivers. The system can include: at least a set of a teethed strap (1); a plug-in device (2) of the strap; the strap (1) being composed by several teeth (4) with a quadratic form; a step in quadratic form belonging to the plug-in device (2), that due to its indenture (3), works as a lever, enabling together with the teeth (4), the blocking and/or fixing of the strap movement, enabling the protector's correct fitting. During use, it is only necessary to press the extremity (10) of the device. The system can be configured to enable a more suitable adjustment and fixation for protection vests, so that the same can be adjusted while the driver is in movement.

17 Claims, 6 Drawing Sheets

ADJUSTMENT AND FIXATION SYSTEM OF PROTECTION VESTS

This application claims the priority benefit under 35 U.S.C. §119 of Portugal Patent Application No. 105529 filed on Feb. 17, 2011, which is hereby incorporated in its entirety by reference.

FIELD

This disclosed subject matter provides a fixation system of protection vests. The vest can be adopted for use, for example, by two-wheeled vehicle drivers.

BACKGROUND

The fixation systems that are presently used for protection vests, normally include two bodies, the frontal part (chest) and the rear part (back), linked by shoulder pads, whose function is to equally protect this part of the body against any type of impact, like stones or other objects, such as vegetation, trunks, and to provide protection in the case of a fall on the ground or into objects. The shoulder pads are typically fixed in a certain position and link the remaining parts of the vest with screws or other fixation systems that need to be released whenever a position change for a better fitting is required. This turns out to be a difficult operation, especially when the driver is in movement. That is, for example, during a competition the driver isn't able to change his vest positioning and correct fitting. The presently disclosed subject matter enables the driver to correct positioning without stopping.

Conventional systems that use a fixation system for their shoulder pads that includes screws and in which the internal belt presents several orifices, may not be very precise, and may result in a limited fitting concerning the distance between the orifices. Disassembly of the vest can also require the use of tools, to make the necessary adjustments. These systems also sometimes require an adequate clamping, that normally depends on the user or the factory's clamping, in order to guarantee the correct performance of the product. However, it may occur that an incorrect or insufficient clamping of the screws may imply a possible separation of the plastic parts, where the excess material may damage the clamping thread or crush the plastic with consequent dysfunctionality of the product.

Below are references to some documents, which describe some conventional systems.

U.S. Pat. No. 5,758,895 describes a clamping set composed by adjustable slabs or belt couplings, featuring a retention notch, applied on snowboards. The system described in this document is composed by a teeth strap with a triangular and not quadratic form, as well as a retention and adjustment device based on a lever, whose extremity also presents an triangular step, that being in contact with the strap and after tightening the lever serves to retain the movement of said strap. Like other remaining systems using triangular teeth, it has the possibility of movement and misfitting of the strap without pressing the device's button. The adjustment system also presents a set of fixation screws that require tools for the refining of the system.

U.S. Pat. No. 4,607,398 discloses a belt and retainer set for diving masks, where the retainer, due to the format, exercises pressure on the belt and fixes it through a step with a triangular form, which fits the teeth of the belt, which have a triangular form. This device disclosed in U.S. Pat. No. 4,607,398 differs from the presently disclosed subject matter in numerous ways. For example, in the form of the belt teeth and the type of retention device, where the disadvantages are obvious, when choosing teeth with a triangular form. Equally, this retainer type does not permit adequate handling, as the adjustment is difficult or cannot be made while the equipment is in use.

SUMMARY

The presently disclosed subject matter is related to an adjustment and fixation system. The system can be used with protection vests. One exemplary type of protection vest is one that can be adopted, for example, by two-wheeled vehicle drivers. The proposed system can include : a teethed strap (1); a plug-in device (2) of the strap; the strap (1) can include several teeth (4) with a quadratic form; the plug-in device (2) can include a step (7) in quadratic form that, due to an indenture (3), works as a lever, that together with the teeth (4) enables the blocking and/or fixing of the strap movement, thus enabling the protector's correct fitting. For this, it is only necessary to press the extremity (10) of the device.

In order for the user to be able to adjust the protection vest at any time, it is enough to simply press on the extremity (10), in order to loosen or tighten the adjustment. In other words, the user can be protected by being able to change a defined clamping if it deems necessary. While adjusting the step (7) the quadratic form of the previously mentioned teeth (4), allows freedom of movement and prevents the vest from tightening/loosening, which could undermine its correct use.

The described system makes it possible to adjust the protection vest without disassembling or removing the vest from the user's body and inclusively, do it, while moving. The links between the shoulder pads (8) and the remaining parts of the vest are done on its front part (11), as seen in FIG. 6, thus enabling a simple and quick adjustment, without needing any further fixing mechanisms, such as screws. This system can also be manufactured in polymeric material, dispensing the use of any metals.

The presently disclosed subject matter can be used for example, by two-wheeled vehicle drivers, for equestrian sports, motorsports and even those activities involving a bicycle, among other applications.

One aspect of the disclosed subject matter includes a fixation system of protection vests that can include:

A strap (1) with several teeth (4) in quadratic form;

A plug-in device (2) of the strap that serves as a guide of the referred strap enabling the fixation and regulation of its course, that comprises:

A step (7) in quadratic form;

An indenture (3) that enables its elevation by being stressed on its extremity (10), working as a lever, and enabling together with its teeth (4) and step (7), the blocking and/or fixing of the strap movement;

An extremity (10) that, when under pressure from a top surface (downward in FIG. 5), causes the step (7) to lift, enabling the adjustment of the teethed strap (1).

In another exemplary embodiment of the fixation system of protection vests, the links between the shoulder pads (8) and the several parts of the protection vest are placed on its front part (11).

In another exemplary embodiment of the fixation system of protection vests, the extremity (10) lifts its step (7) by being stressed, enabling the movement of the teethed strap (1).

In still another exemplary embodiment of the fixation system of protection vests, the plug-in device (2) is composed by one element (5) that works at the same time as an axis and at least through two saliences (6) on one of its ends.

In another exemplary embodiment of the fixation system for protection vests, the plug-in device (2) is adopted in brims (9) of a protection vest.

In another exemplary embodiment, the fixation system for protection vests is manufactured in polymeric material, namely polyamide, polypropylene, polyethylene, polyvinyl chloride, among others.

DESCRIPTION OF THE DRAWINGS

Enclosed follow some drawings for a better understanding of the disclosed subject matter. The figures represent exemplary embodiments of the disclosed subject matter that, however, should not be considered to limit the scope of the presently disclosed subject matter.

FIG. 1: Schematic drawing of an exemplary embodiment of an adjustment and fixation system made in accordance with principles of the disclosed subject matter in which the following numbers stand for:

1—Teethed Strap
2—Plug-in Device
3—Indenture
4—Teeth
10—Pressure Extremity FIG. 2: Schematic drawing of the adjustment and fixation system in which the following numbers stand for:

1—Teethed Strap
2—Plug-in Device
3—Indenture
4—Teeth
5—Plug-in Device/Axis
10—Pressure Extremity FIG. 3: Schematic top view drawing of the plug-in, fixation and regulation device of the strap in which following numbers stand for:

2—Plug-in Device
3—Indenture
4—Teeth
5—Plug-in Device/Axis
6—Saliences
10—Pressure Extremity FIG. 4: Schematic side view drawing of the plug-in, fixation and regulation device of the strap, in which following numbers stand for:

2—Plug-in, Fixation and Regulation Device of the Strap
5—Plug-in Device/Axis
7—Step
10—Pressure Extremity FIG. 5: Schematic side view drawing of the plug-in, fixation and regulation device of the strap, in which following numbers stand for:

1—Teethed Strap
2—Plug-in Device
3—Indenture
4—Teeth
5—Plug-in Device/Axis
7—Step
10—Pressure Extremity FIG. 6: Schematic drawing of the adjustment and fixation system incorporated into a vest, in which following numbers stand for:

Figure 1:
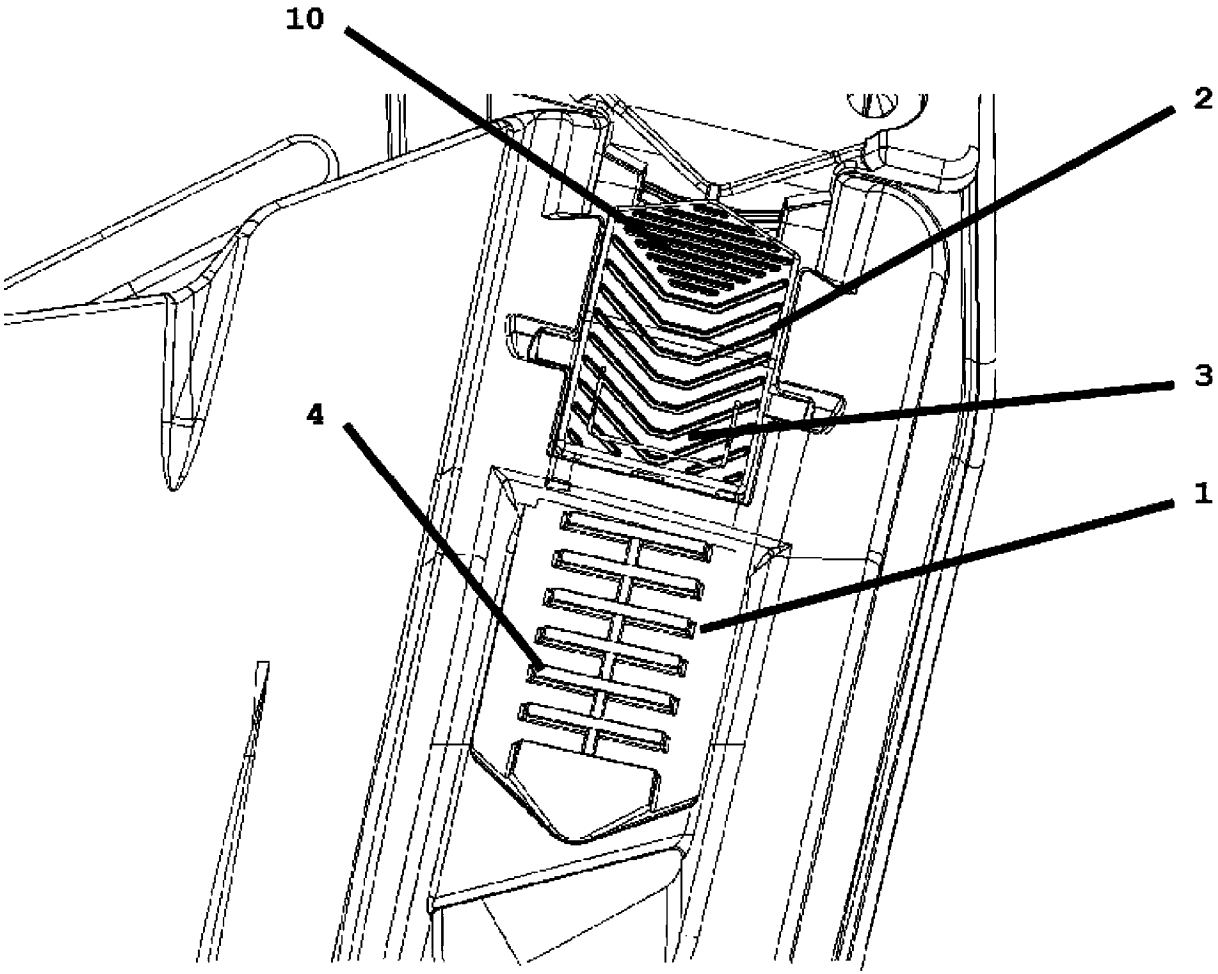
Figure 2:
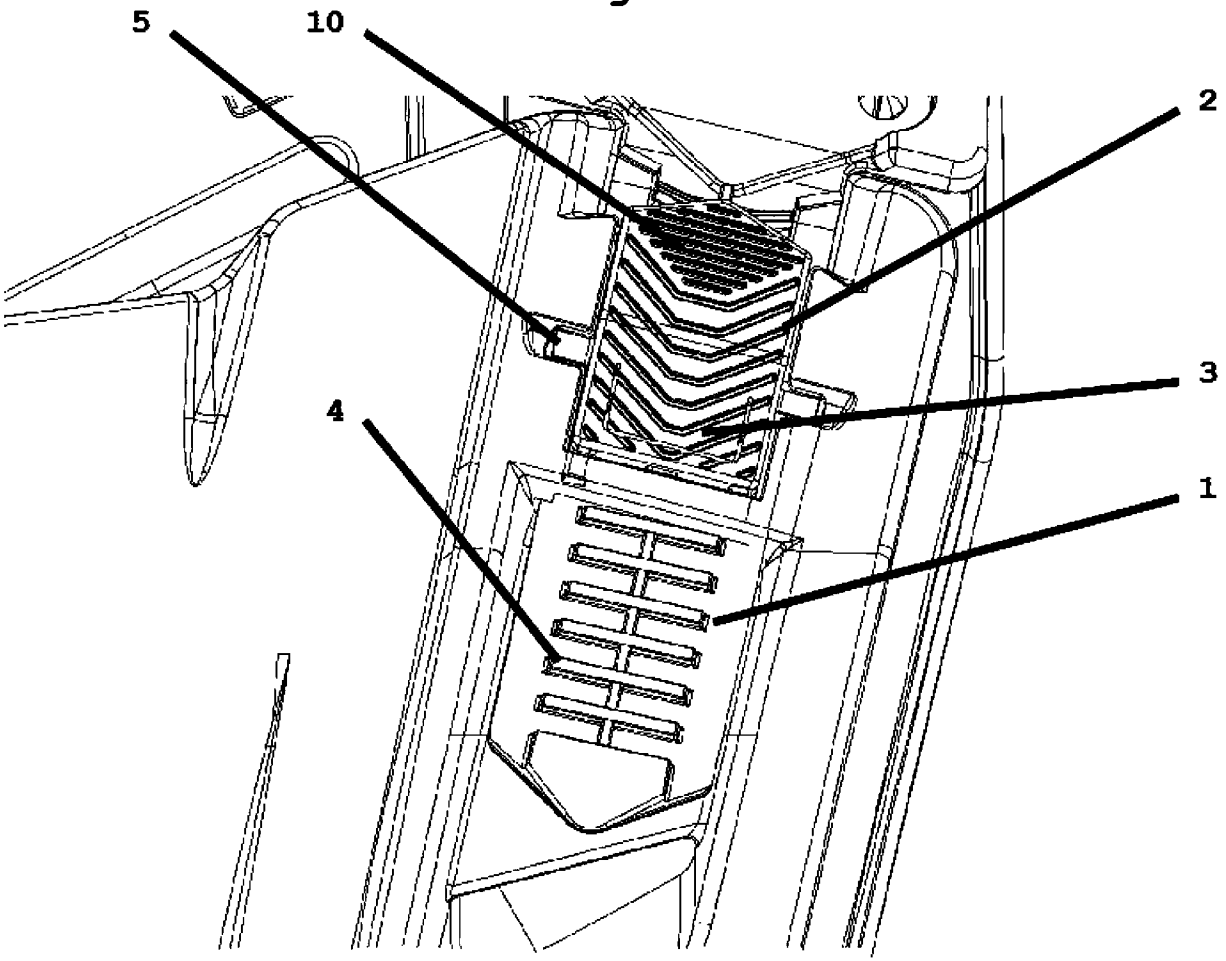

8—Shoulder Pads
9—Brims
11—Frontal Part of the Vest

DETAILED DESCRIPTION OF EXEMPLARY EMBODIMENTS

The presently disclosed subject matter is related to an adjustment and fixation system. The system can be used, for example, in protection vests that can be adopted for example by two-wheeled vehicle drivers. The system can include: a teethed strap (1); a plug-in device (2) of the strap; the referred strap (1) being composed by several teeth (4) with a quadratic form; a step (7) in quadratic form belonging to the plug-in device (2), and an indenture (3) which works as a lever, enabling together with the teeth (4), the blocking and/or fixing of the strap movement, enabling the protector's correct fitting. For this, it is only necessary to press the extremity (10) of the referred device.

Figure 5:
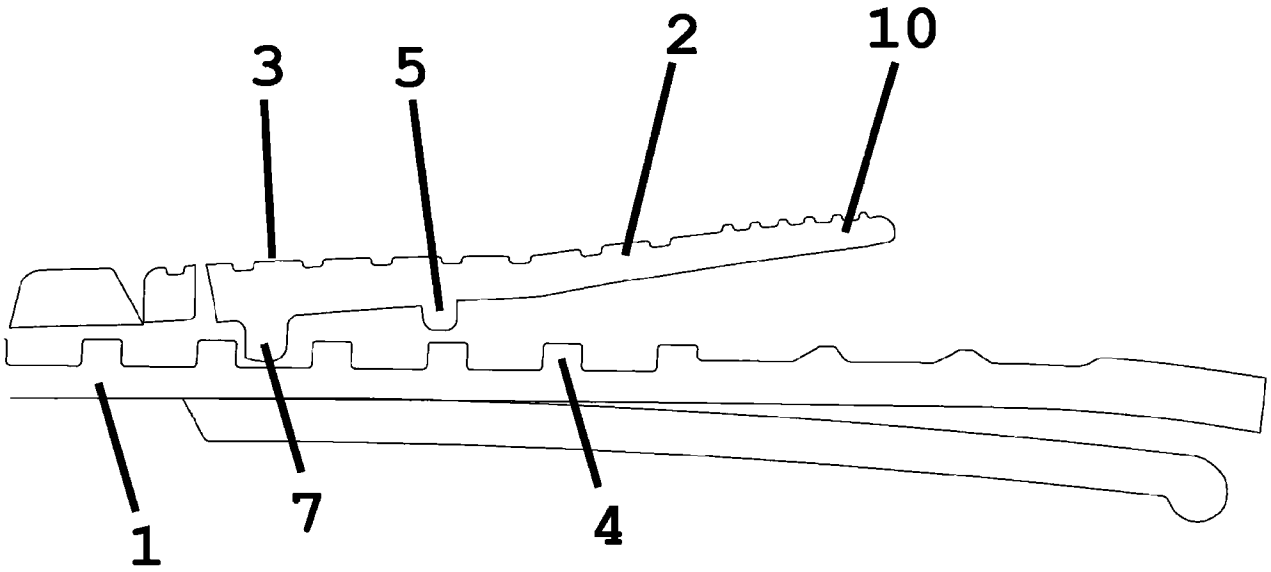

While the extremity (10) is pressed, the step (7) is lifted, and therefore the teethed strap can be moved, proceeding to its adjustment, as seen in FIG. 5.

Figure 3:
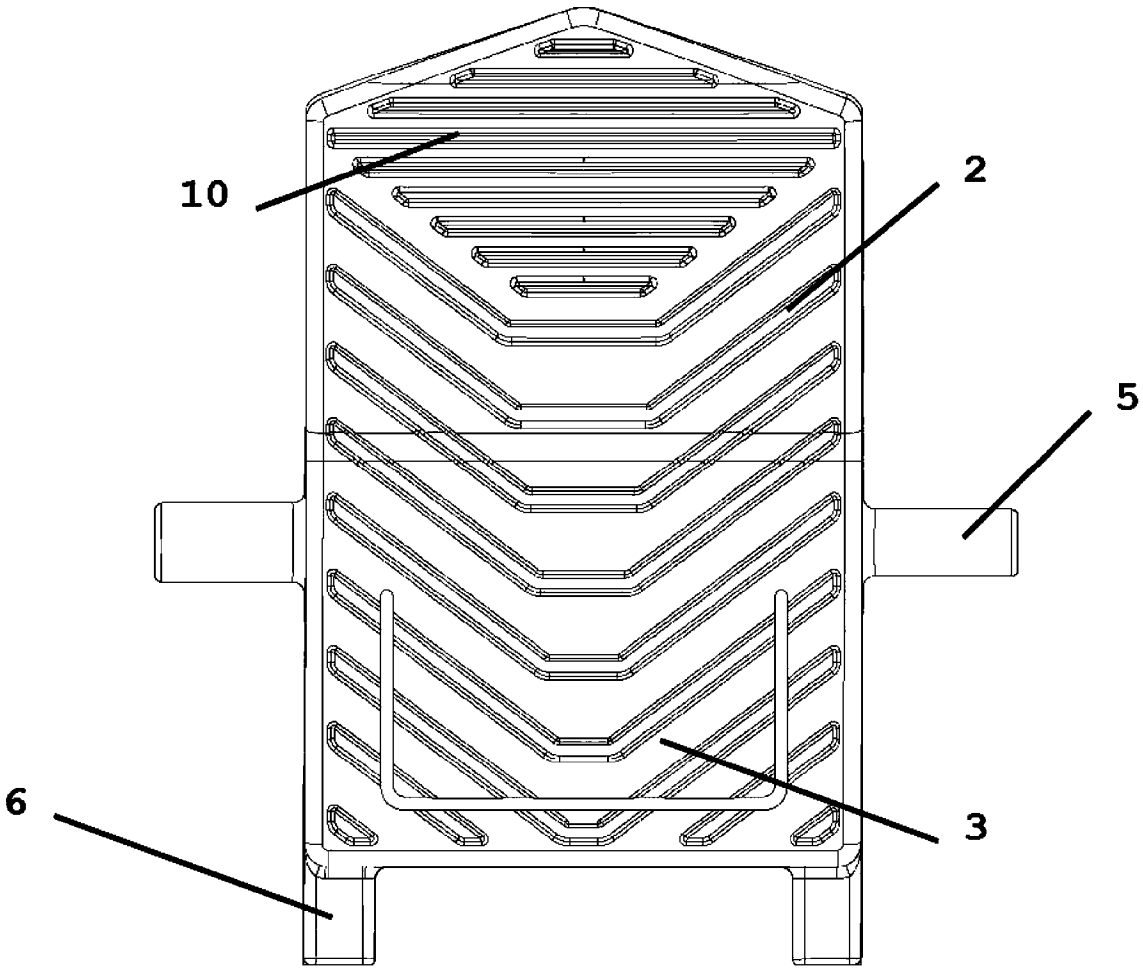
Figure 4:
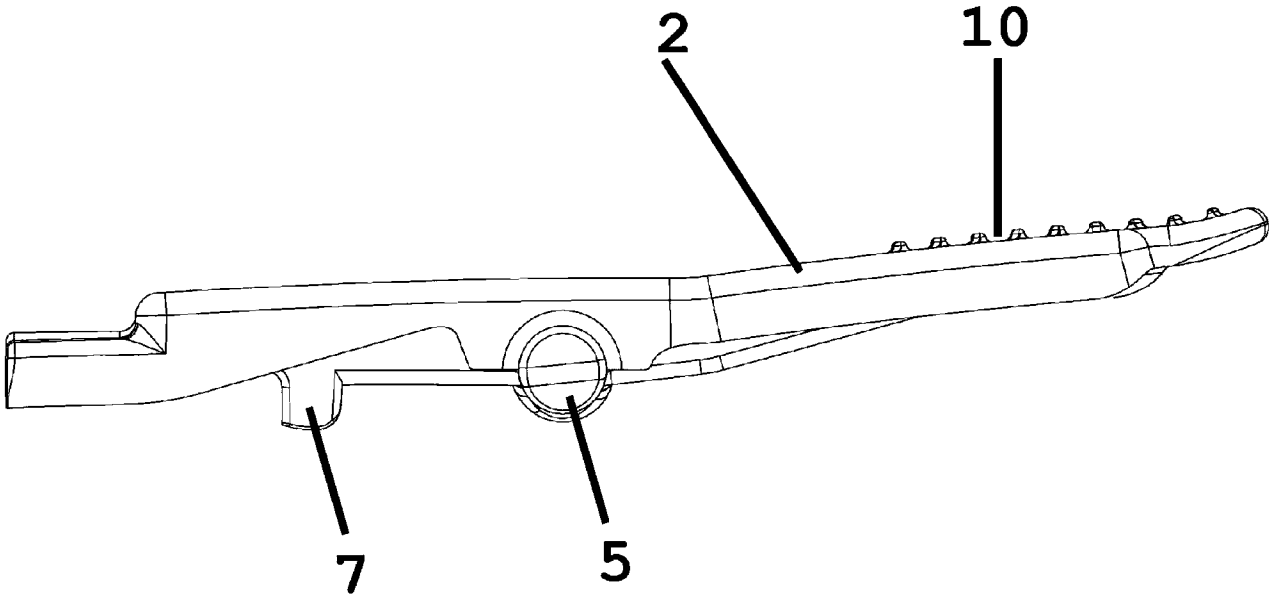

When the extremity (10) is not pressed, the indenture (3) that works as a lever keeps the step (7) pressed against the strap and fitted between the teeth in quadratic form (4) of the same, fixing its positioning. The quadratic form of the step (7) and the teeth (4) avoid movements that could lead to the misfitting of the vest, as happens with devices where the clamping devices present triangular teeth. In order to clamp into the existing coupling devices in the front part (11) of the vest, the clamping device (2) includes element (5) that works as an axis at the same time, facilitating the movement of the lever type structure, when the extremity (10) is pressed. Similarly, the device (2) can include at least two saliences (6) on one of its ends, as seen in FIG. 3, enabling the appropriate fitting into the existing coupling elements of the front part (11) of the vest. The quadratic form of the teeth (4) and the step (7) enable the fixation and adjustment of the vest such that they are only movable when pressing on extremity (10). A cross section of the step (7) and teeth (4) as viewed from a side of the device (as shown in FIG. 5) can be substantially square or substantially rectangular in shape. In addition, the step (7) and teeth (4) can be rectangular in shape as viewed from a top view (as shown in FIG. 1). The step (7) can be the same width as the steps (4) as viewed from the top view, or can be shorter, or longer depending on particular application.

Figure 6:
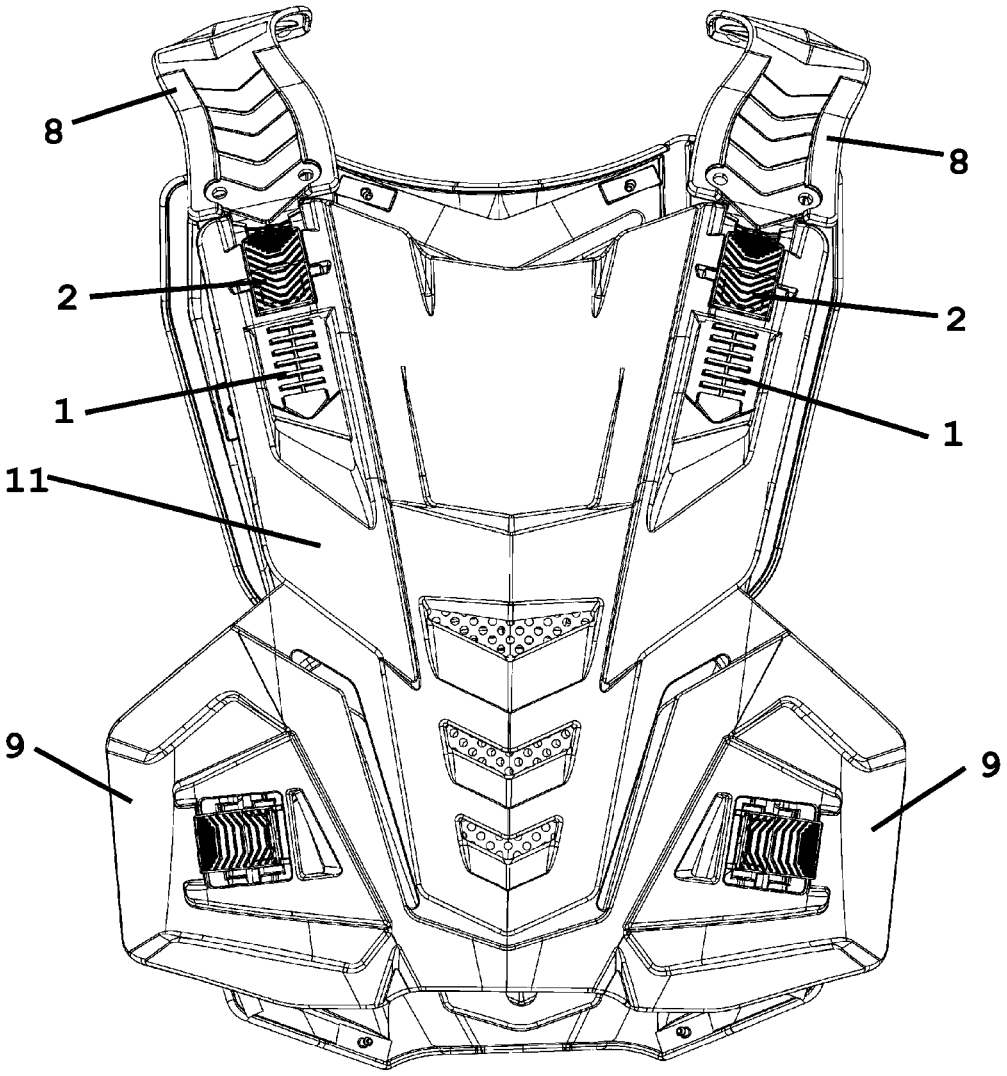

Similarly, the device can be adopted for fixation and adjustment of other parts of the protection vests as seen in FIG. 6, where its use in brims (9) enable the fitting of the lower parts of these type of vests, therefore increasing the protection level for its users.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A fixation system for a protection vest, comprising:
a strap with teeth in quadratic form; and
a plug-in device that serves as a guide for the strap enabling fixation and regulation of a course for the strap, the plug-in device including
a step in quadratic form, and
an indenture configured to cause elevation of the step relative to the strap by action of the plug-in device being pressed on an extremity of the plug-in device, the plug-in device working as a lever, and enabling together with one of the teeth and the step, a blocking and/or fixing of movement of the strap relative to the plug-in device,
wherein the extremity when pressed causes the step to lift relative to the strap, wherein the plug-in device further includes a fulcrum element extending substantially normal to and away from a longitudinal axis of the plug-in device, and wherein the fulcrum element is configured to contact a top most surface of the teeth of the strap when the strap is inserted in the plug-in device and the step is locked with the teeth, the top most surface of the teeth being a top land of the teeth, thus enabling adjustment of the strap.

2. The fixation system according to the claim 1, wherein the plug-in device includes an element configured to fit into an existing coupling element located on a front part of the vest, and the element is configured to serve as an axis of rotation for the plug-in device.

3. A protection vest comprising a fixation system according to claim 2, to enable linkage and adjustment of multiple parts of the vest.

4. The fixation system according to the claim 1, wherein the plug-in device includes two saliences on an extremity of the plug-in device, thus enabling fitting of the plug-in device into an existing coupling element located on a front part of the vest.

5. A protection vest comprising a fixation system according to claim 4, to enable linkage and adjustment of multiple parts of the vest.

6. The fixation system according to the claim 1, wherein the plug-in device is configured to be coupled to at least one brim of the vest.

7. A protection vest comprising a fixation system according to claim 4, to enable linkage and adjustment of multiple parts of the vest.

8. The fixation system according to the claim 1 wherein the system is made of polymeric material.

9. A protection vest comprising a fixation system according to claim 8, to enable linkage and adjustment of multiple parts of the vest.

10. A protection vest comprising a fixation system according to claim 1, to enable linkage and adjustment of multiple parts of the vest.

11. A protection vest comprising a fixation system according to claim 1, to enable linkage and adjustment of multiple parts of the vest.

12. A fixation system, comprising:

a strap with teeth in quadratic form; and a plug-in device that serves as a guide for the strap enabling fixation and regulation of a course for the strap, the plug-in device including, a step in quadratic form configured to lock with one of the teeth of the strap, an extremity of the plug-in device located at a first distal end of the plug-in device, an indenture configured to cause elevation of the step relative to the strap by action of the plug-in device being pressed on the extremity of the plug-in device, the plug-in device working as a lever when pressed, and enabling together with the teeth and step, a blocking of movement of the strap relative to the plug-in device, wherein the extremity when pressed causes the step to lift relative to the strap, thus enabling adjustment of the strap, wherein the plug-in device further includes a fulcrum element extending substantially normal to and away from a longitudinal axis of the plug-in device, and wherein the fulcrum element is configured to contact a top most surface of the teeth of the strap when the strap is inserted in the plug-in device and the step is locked with the teeth, the top most surface of the teeth being a top land of the teeth.

13. The fixation system according to the claim 12, wherein the fulcrum element is configured to serve as an axis of rotation for the plug-in device when the extremity is pressed.

14. The fixation system according to the claim 12, wherein the plug-in device includes two saliences extending from the plug-in device, thus enabling fitting of the plug-in device into an existing coupling element located on a front part of a vest.

15. The fixation system according to the claim 12, wherein the plug-in device is configured to be coupled to at least one brim of a vest.

16. The fixation system according to the claim 12, wherein the system is made of polymeric material.

17. A protection vest comprising a fixation system according to claim 12, to enable linkage and adjustment of multiple parts of the vest.

* * * * *